US006783225B2

(12) United States Patent
Burns et al.

(10) Patent No.: US 6,783,225 B2
(45) Date of Patent: Aug. 31, 2004

(54) VACUUM FEEDER FOR IMAGING DEVICE

(75) Inventors: Roland John Burns, Fort Collins, CO (US); David D Bohn, Ft Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 20 days.

(21) Appl. No.: 10/234,503

(22) Filed: Sep. 4, 2002

(65) Prior Publication Data

US 2003/0002907 A1 Jan. 2, 2003

Related U.S. Application Data

(62) Division of application No. 09/505,079, filed on Feb. 16, 2000, now Pat. No. 6,467,895.

(51) Int. Cl.[7] ..... B41J 2/01; B41J 2/35; B41J 13/10

(52) U.S. Cl. ..... 347/101; 347/211; 347/102; 347/104; 347/105; 347/106; 400/188; 400/578; 400/611; 400/624; 400/625

(58) Field of Search ..... 347/101, 104, 347/105, 106; 400/625, 624, 578, 611; 271/94, 95, 99, 108

(56) References Cited

U.S. PATENT DOCUMENTS

| | | | | |
|---|---|---|---|---|
| 4,389,117 A | | 6/1983 | Floyd et al. | |
| 4,482,145 A | * | 11/1984 | Feldkamper et al. | 271/95 |
| 4,561,352 A | * | 12/1985 | Svyatsky et al. | 101/2 |
| 5,114,302 A | * | 5/1992 | Meisser et al. | 414/751.1 |
| 5,757,407 A | * | 5/1998 | Rezanka | 347/102 |
| 6,111,847 A | * | 8/2000 | Assadian | 369/30.55 |
| 6,141,298 A | * | 10/2000 | Miller | 369/30.33 |
| 6,467,895 B1 | * | 10/2002 | Burns et al. | 347/101 |

FOREIGN PATENT DOCUMENTS

| | | |
|---|---|---|
| DE | 3514988 | 9/1988 |
| EP | 0765736 | 2/1997 |
| GB | 1161054 | 8/1969 |
| WO | WO86/05472 | 9/1986 |

* cited by examiner

*Primary Examiner*—Edward Lefkowitz
*Assistant Examiner*—Marvin P Crenshaw

(57) ABSTRACT

Media is transported to an imaging region using a vacuum feeder. A vacuum head is positioned onto the media and a vacuum is applied to the vacuum head to hold the media against the vacuum head. The vacuum head is then relocated to the imaging region carrying with it the media. In one embodiment, the vacuum head holds the media slightly above the surface of the imaging region. After the media is imaged, the vacuum head moves the media to an output region. In the output region the vacuum is removed from the vacuum head allowing the media to detach from the vacuum head and remain in the output region. In another embodiment, the vacuum is removed from the vacuum head allowing the media to detach from the vacuum head and remain in the imaging region. A second vacuum head is positioned in the imaging region onto the media and a vacuum is applied to the second vacuum head to hold the media against the second vacuum head. The second vacuum head is then relocated to the output region carrying with it the media. The second vacuum head moves the media to an output region. In the output region the vacuum is removed from the second vacuum head allowing the media to detach from the second vacuum head and remain in the output region.

18 Claims, 7 Drawing Sheets

VACUUM FEEDER FOR IMAGING DEVICE

CROSS REFERENCE TO RELATED APPLICATION

This is a divisional of application Ser. No. 09/505,079 filed on Feb. 16, 2000 now U.S. Pat. No. 6,467,895, which is hereby incorporated by reference herein.

FIELD OF THE INVENTION

This invention relates in general to a feeder system and, more particularly, to a vacuum feeder system for imaging devices.

BACKGROUND OF THE INVENTION

In the current state of technology, document imaging has become commonplace. Documents are routinely, scanned, photocopied, and transmitted by facsimile machine. The use of these imaging processes is not limited to text documents. Photographs are now routinely imaged as well. As imaging of photographs has become more widespread, a desire has arisen to automate the imaging of multiple photographs.

Although it is possible to process multiple photographs using the same automated technology used for standard paper documents, there are drawbacks to doing so. The surface of a photograph is much more susceptible to marring than standard paper documents. Conventional rubber rollers used to process paper documents are capable of leaving skid and scratch marks across the surface of the photograph or crumpling the photograph in a paper jam.

Loss caused by damaged or destroyed photographs is oftentimes deeper than loss of an ordinary paper document. Photographs are often more valuable than ordinary paper documents. Some photographs are irreplaceable as the negative is unavailable or the photograph was produced from a method that did not result in a reusable negative.

It is for instances where photographs are valuable that the need is especially keen for a feeder system that will not harm the photographs. Additionally, some paper documents are particularly valuable or delicate. A feeder system that will accommodate these paper documents would also be desirable.

SUMMARY OF THE INVENTION

According to principles of the present invention, media is transported to an imaging region using a vacuum feeder. A vacuum head is positioned in an input region onto the media and a vacuum is applied to the vacuum head to hold the media against the vacuum head. The vacuum head is then relocated to the imaging region carrying with it the media.

According to further principles of the present invention in one embodiment, the vacuum head is nearly coextensive with the media and the vacuum head holds the media slightly above the surface of the imaging region. After the media is imaged, the vacuum head moves the media to an output region. In the output region the vacuum is removed from the vacuum head allowing the media to detach from the vacuum head and remain in the output region. The vacuum head then returns to the input region to retrieve another media.

According to further principles of the present invention in another embodiment, the vacuum is removed from the vacuum head allowing the media to detach from the vacuum head and remain in the imaging region. The vacuum head then returns to the input region to retrieve another media. Simultaneously, a second vacuum head is positioned in the imaging region onto the media and a vacuum is applied to the second vacuum head to hold the media against the second vacuum head. The second vacuum head is then relocated to the output region carrying with it the media. The second vacuum head then moves the media to an output region. In the output region the vacuum is removed from the second vacuum head allowing the media to detach from the second vacuum head and remain in the output region. The second vacuum head then returns to the imaging region to retrieve another media left in the imaging region by the first vacuum head.

Other objects, advantages, and capabilities of the present invention will become more apparent as the description proceeds.

DETAILED DESCRIPTION OF THE INVENTION

Figure 1:
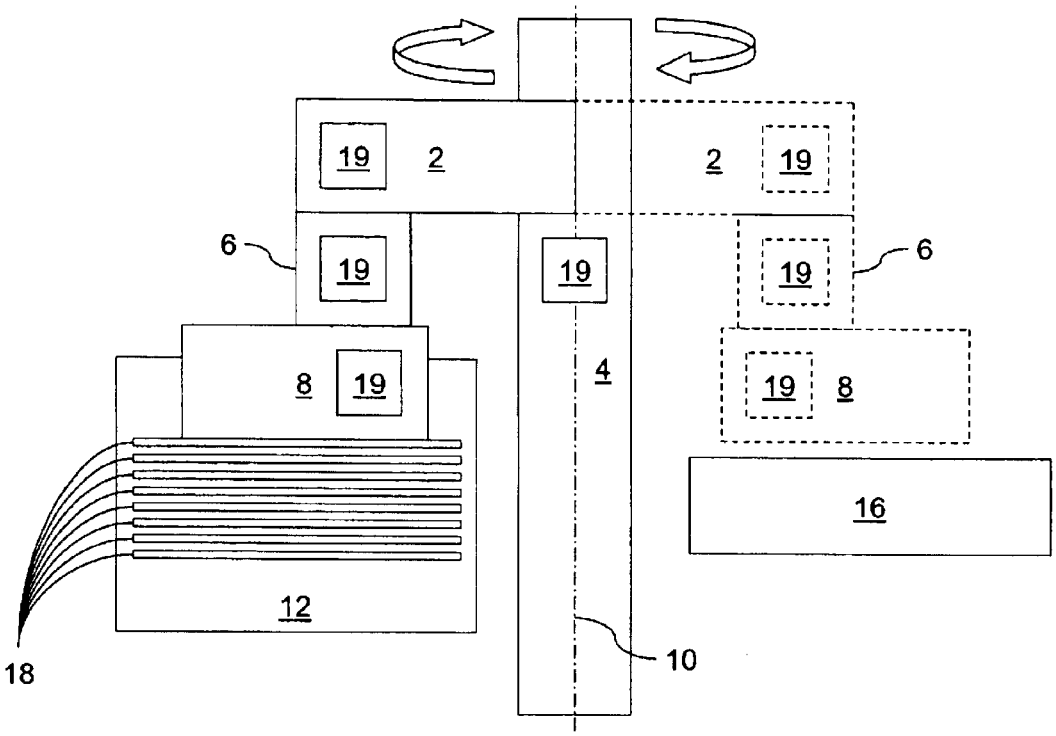
FIG. 1 is a side view diagram illustrating one embodiment of the system of the present invention.
Figure 2:
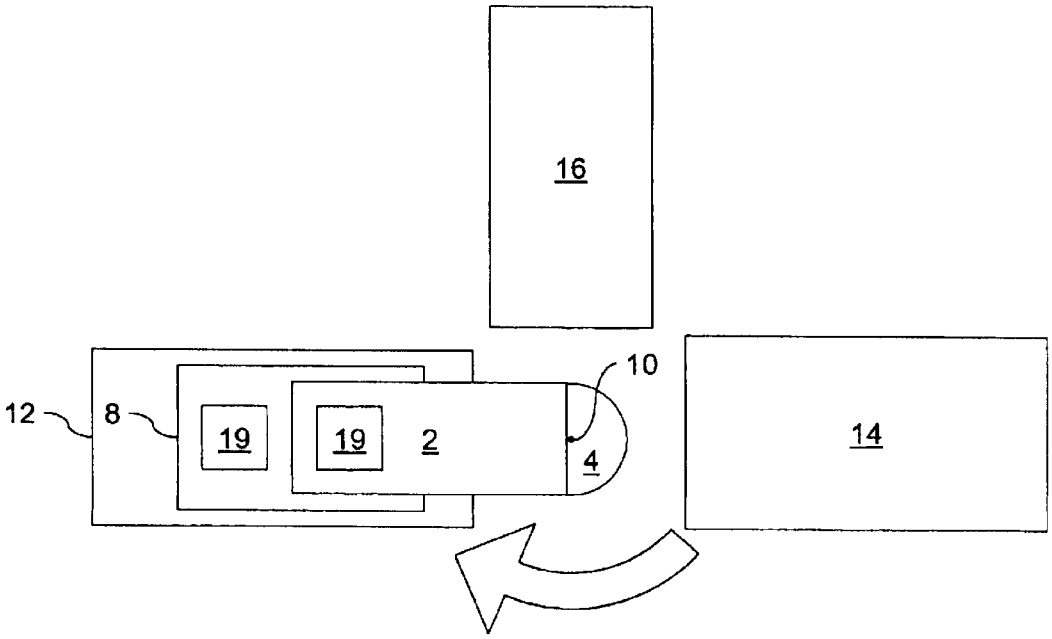
FIG. 2 is a top view diagram of the embodiment of the present invention shown in FIG. 1.

Illustrated in FIGS. 1 and 2 is one embodiment of the system of the present invention. A beam 2 is mounted to a shaft 4. A support arm 6 is attached to beam 2. A vacuum head 8 is supported by support arm 6. Vacuum is supplied to vacuum head 8 by a vacuum system (not shown). The vacuum system may be any system for providing a controlled vacuum to vacuum head 8.

In one embodiment vacuum head 8 is a flat, perforated surface. Alternatively, other configurations of vacuum head 8 are also acceptable. Vacuum head 8 may be any size. However, a size roughly coextensive with a standard photograph is most desirable for vacuum head 8.

Vacuum head 8 is rotatable about a longitudinal axis 10 of shaft 4 and moveable parallel to longitudinal axis 10. Optionally, vacuum head 8 is also moveable perpendicular to longitudinal axis 10.

Vacuum head 8 may be made rotatable about longitudinal axis 10 using a variety of means. In one embodiment, shaft 4 is rotatable about longitudinal axis 10. The rotation of shaft 4 about longitudinal axis 10 is transferred to beam 2, support arm 6, and vacuum head 8 causing vacuum head 8 to rotate about longitudinal axis 10. In another embodiment, shaft 4 remains fixed relative to rotation about longitudinal axis 10 while beam 2 rotates about shaft 4 and longitudinal axis 10. The rotation of beam 2 about longitudinal axis 10 is transferred to support arm 6 and vacuum head 8.

Vacuum head 8 may also be made moveable parallel to longitudinal axis 10 using a variety of means. In one embodiment, shaft 4 is moveable parallel to longitudinal axis 10. The movement of shaft 4 about longitudinal axis 10 is transferred to beam 2, support arm 6, and vacuum head 8 causing vacuum head 8 to move parallel to longitudinal axis 10. In another embodiment, shaft 4 remains fixed relative to movement parallel to longitudinal axis 10 while beam 2 moves parallel to longitudinal axis 10. The movement of beam 2 parallel to longitudinal axis 10 is transferred to support arm 6 and vacuum head 8. In still another embodiment, both beam 2 and shaft 4 remain fixed relative to movement parallel to longitudinal axis 10 while support arm 6 moves parallel to longitudinal axis 10. The movement of support arm 6 parallel to longitudinal axis 10 is transferred to vacuum head 8. In a fourth embodiment, beam 2, shaft 4, and support arm 6 remain fixed relative to movement parallel to longitudinal axis 10 while vacuum head 8 moves parallel to longitudinal axis 10.

For each movement of vacuum head 8 relative to longitudinal axis 10, some mechanical device and control system is required for causing the movement. Suitable devices and control systems for each of the above described movements are well known in the art and do not require detailed description here as the present invention may be practiced using any suitable devices and control systems. Together the mechanical device and control system for causing the required movements will be referred to as a driver 19.

Referring again to FIGS. 1 and 2, an input region 12, an output region 14, and an imaging region 16 are positioned about shaft 4. In one embodiment, input region 12, output region 14, and imaging region 16 are arranged on one surface, such as the scanning surface of a scanner. Input region 12 is an area such as a bin, hopper, tray, or surface for storing media 18 before being imaged. Output region 14 is likewise a bin, hopper, tray, or surface for storing media 18 after being imaged. Media 18 is any media capable of being imaged. Examples of media 18 include photographs and paper documents. Imaging region 16 is a region for imaging media 18. Examples of types of imaging regions 16 include a scanning surface for a scanner and an imaging surface for a photocopier or a facsimile machine including the immediately adjacent the scanning or imaging surface.

Figure 3:
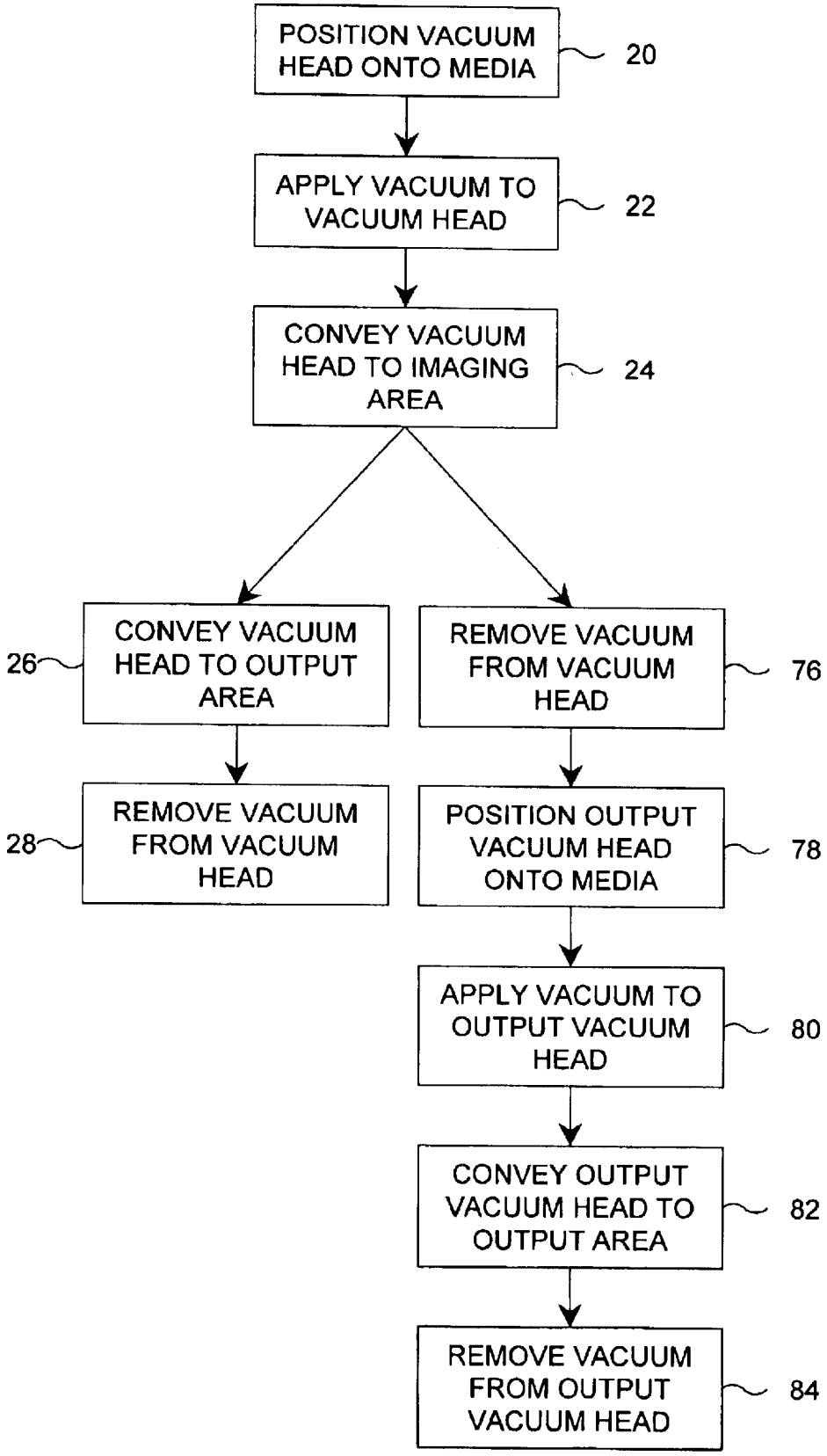
FIG. 3 is a flow chart illustrating two embodiments of the method of the present invention.

FIG. 3 illustrates a method for feeding media 18 to imaging region 16. Vacuum head 8 is positioned 20 onto media 18 in input region 12. A vacuum of sufficient volume for lifting media 18 is then applied 22 to vacuum head 8. Vacuum head 8 is then conveyed 24 into imaging region 16 carrying media 18 to be imaged. Vacuum head 8 is conveyed 24 into imaging region 16 by rotating vacuum head 8 about longitudinal axis 10 of shaft 4 and moving vacuum head 8 parallel to longitudinal axis 10 as necessary to avoid obstructions in input region 12 and imaging region 16. For example, if input region 12 includes an input bin having walls, moving vacuum head 8 parallel to longitudinal axis 10 may be necessary before rotating vacuum head 8 to imaging region 16.

In one embodiment, vacuum head 8 positions media 18 onto an imaging or scanning surface of imaging region 16. In another embodiment, vacuum head 8 positions media 18 so that a small gap exists between media 18 and an imaging or scanning surface of imaging region 16. Allowing a small gap between media 18 and an imaging or scanning surface of imaging region 16 ensures that media 18 is not marred or damaged by contact with a surface of imaging region 16.

In order to process additional media 18, the media 18 held by vacuum head 8 must be discarded without covering imaging region 16. Vacuum head 8 is conveyed 26 to output region 14 carrying media 18. Vacuum head 8 is conveyed 26 into output region by rotating vacuum head 8 about longitudinal axis 10 of shaft 4 and moving vacuum head 8 parallel to longitudinal axis 10 as necessary to avoid obstructions in imaging region 16 and output region 14. For example, if output region 14 includes an output bin having walls, moving vacuum head 8 parallel to longitudinal axis 10 may be necessary before rotating vacuum head 8 to output region 14.

Upon arrival of media 18 into output region 14, the vacuum applied to vacuum head 8 is removed 28 allowing media 18 to detach from vacuum head 8. Media 18 remains in output region 14 as vacuum head 8 is returned to input region 12 for processing additional media 18.

Figure 4:
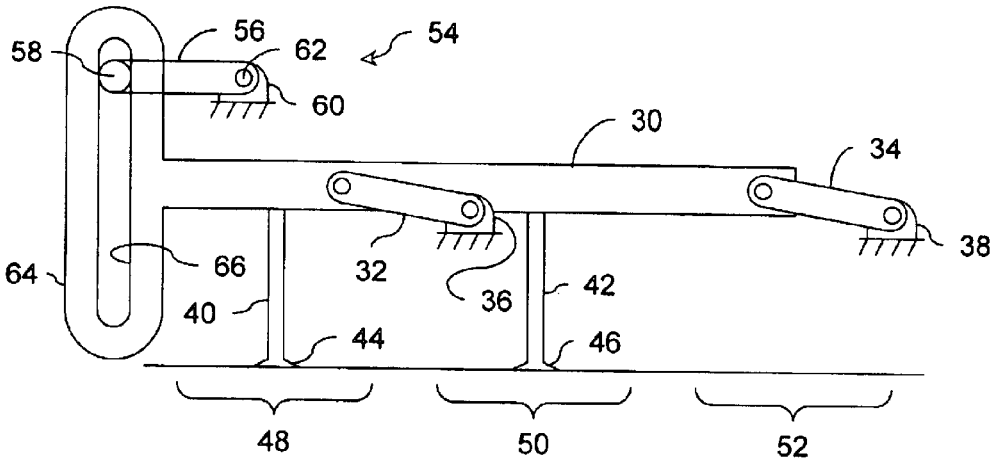
FIGS. 4 through 6 are side view diagrams of an alternate embodiment of the system of the present invention.
Figure 5:
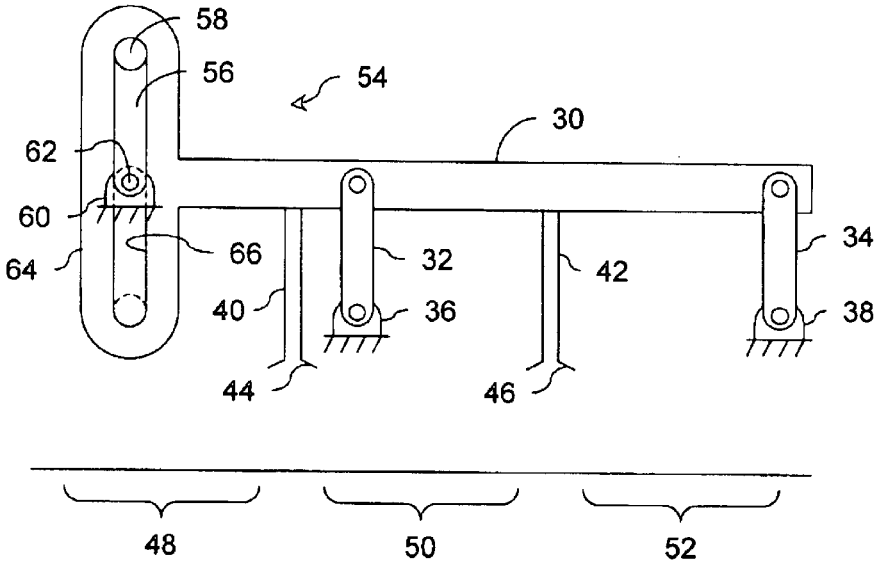
Figure 6:
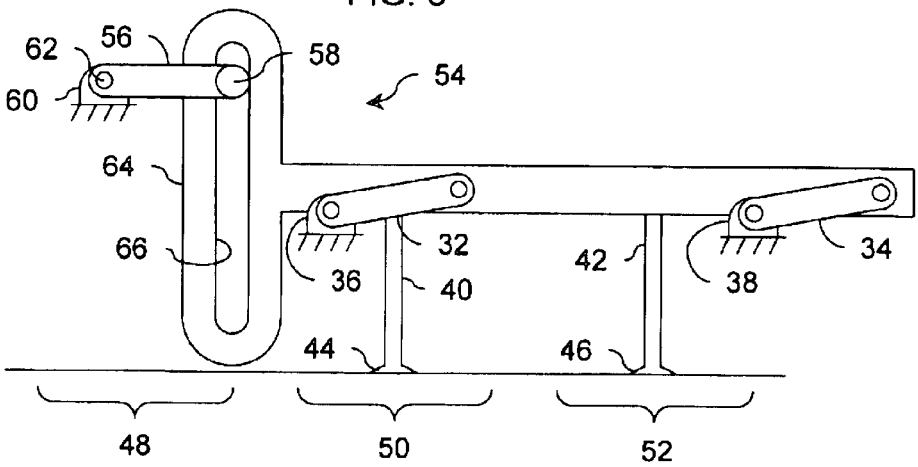

FIGS. 4 through 6 illustrate an alternate embodiment to the system described above and illustrated in FIGS. 1 and 2. A beam 30 is pivotally supported by two rocker arms 32, 34. Rocker arms 32, 34 are each pivotally attached to mounts 36, 38. Beam 30, rocker arms 32, 34 and mounts 36, 38 are linearly arranged so that beam 30 is moveable in a two-dimensional arcing motion pivoting on rocking arms 32, 34.

Affixed to beam 30 are two support arms 40, 42. Support arms 40, 42 are attached to beam 30 at the distal ends of support arms 40, 42. Affixed to the proximal ends of support arms 40, 42 are input and output vacuum heads 44, 46. Support arms 40, 42 and input and output vacuum heads 44, 46 are sized and located so that when beam 30 is at the endpoints of the arcing motion, vacuum heads 44, 46 contact or closely approach an input region 48, an imaging region 50, and an output region 52. Vacuum heads 44, 46 are sized and located to either contact or closely approach the regions 48, 50, 52 depending on the desired proximity of media 18 to surfaces of the regions 48, 50, 52.

As illustrated in FIGS. 4 and 6, input vacuum head 44 contacts or approaches input region 48 at one end of the arcing motion of beam 30 and imaging region 50 at the other end of the arcing motion of beam 30. Likewise, output vacuum head 46 contacts or approaches imaging region 50 at one end of the arcing motion of beam 30 and output region 52 at the other end of the arcing motion of beam 30.

Linked to beam 30 is a driver 54 for propelling beam 30 through the arcing motion. Driver 54 includes a rotating arm 56 having proximate and distal ends, a roller 58 rotatably affixed to the distal end of rotating arm 56, a motor 60 having a rotating shaft 62 affixed to the proximate end of rotating arm 56, and a roller retainer 64 affixed to beam 30 and having a slot 66 formed therein for capturing roller 58.

As motor shaft 62 rotates about its longitudinal axis, rotating arm 56 rotates in a circular motion. As rotating arm 56 moves in a circular motion, roller 58 rides in slot 66 driving beam 30 in an arcing motion. FIGS. 4 through 6 illustrate the position of beam 30 at 90? intervals of rotating arm 56.

FIG. 5 illustrates beam 30 at the apex of the arcing motion. Beam 30 arrives at the apex of the arcing motion at two of the 90? intervals. Rotating arm 56 and roller 58 are shown as solid line for one of the intervals and as dashed lines for the other interval.

Figure 7:
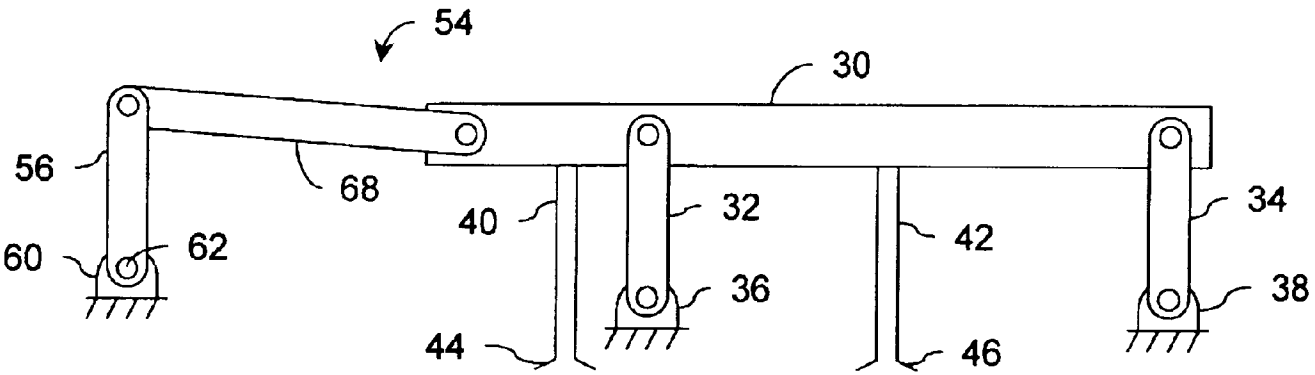
FIGS. 7 and 8 are side elevations illustrating alternate embodiments of the driver shown in FIGS. 4 through 6.
Figure 8:
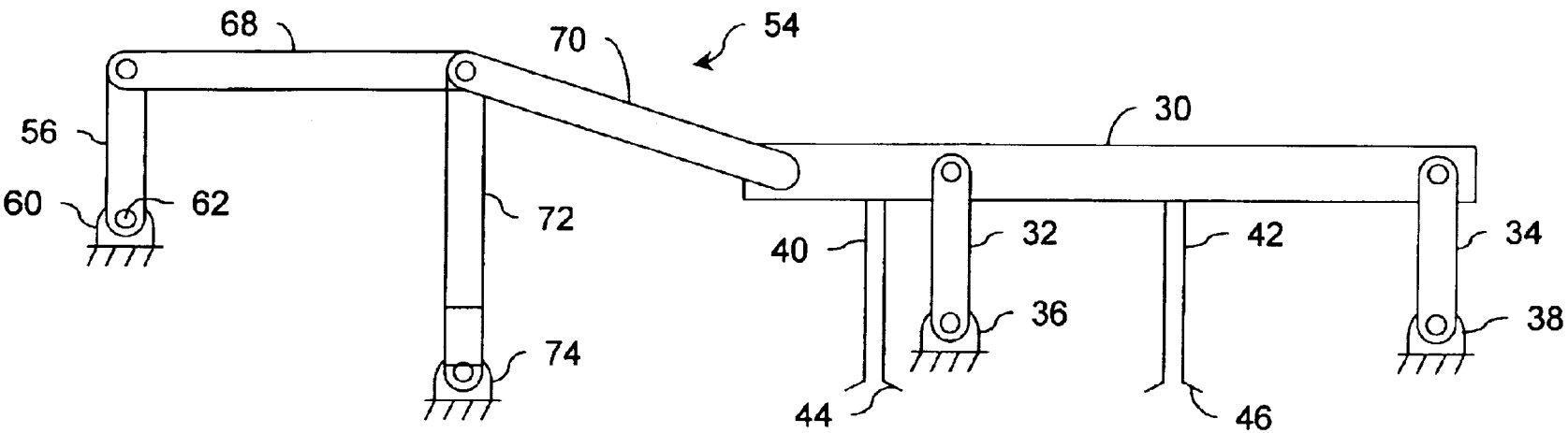

Illustrated in FIGS. 7 and 8 are alternate embodiments of driver 54 for beam 30. FIG. 7 illustrates a single coupler design for driving beam 30. The single coupler design is similar to the previously described embodiment of driver 54 except that instead of transferring the motion of rotating motor 60 to beam 30 through a roller 56 and roller retainer 66, a coupler 68 interconnects rotating arm 56 and beam 30.

Coupler 68 is pivotally attached to both beam 30 and the distal end of rotating arm 56.

FIG. 8 illustrates a double coupler design, a variation of the single coupler design described above and shown in FIG. 7. The double coupler design includes a second coupler 70 interconnecting beam 30 and rotating arm 56. Second coupler 70 is pivotally attached to both coupler and beam 30. Also attached to the joint between coupler 68 and second coupler 70 is a third rocker arm 72 pivotally attached to a third mount 74.

The single and double coupler designs for driver 54 illustrated in FIGS. 7 and 8 are shown in one embodiment. Alternative embodiments for single and double coupler designs are well known in the art. For example, rotating motor 60, coupler 68, second coupler 70, and rocker arm 72 may be in a nested configuration with beam 30. The present invention encompasses all such variations in placement of rotating motor 60 coupler 68, second coupler 70, and rocker arm 72. Other embodiments of driver 54, not described here, are also possible and within the scope of the present invention.

Referring again to FIG. 3, a method is illustrating for transferring media 18 to imaging region 50. Input vacuum head 44 is positioned 20 onto media 18 in input region 48. A vacuum of sufficient volume for lifting media 18 is then applied 22 to input vacuum head 44. Input vacuum head 44 is then conveyed 24 into imaging region 50 carrying media 18 to be imaged. Input vacuum head 44 is conveyed 24 into imaging region 16 by rocking beam 30 on rocking arms 32, 34.

In one embodiment, input vacuum head 44 positions media 18 onto an imaging or scanning surface of imaging region 50. In another embodiment, input vacuum head 44 positions media 18 so that a small gap exists between media 18 and an imaging or scanning surface of imaging region 50. Allowing a small gap between media 18 and an imaging or scanning surface of imaging region 50 ensures that media 18 is not marred or damaged by contact with a surface of imaging region 16.

In order to process additional media 18, the media 18 held by input vacuum head 44 must be discarded without covering imaging region 50. The vacuum applied to input vacuum head 44 is removed 76 allowing media 18 to detach from input vacuum head 44. Media 18 remains in imaging region 50 as input vacuum head 44 is returned to input region 48 for processing additional media 18.

In order to remove media 18 from imaging region 50, output vacuum head 46 is positioned 78 onto media 18. A vacuum of sufficient volume for lifting media 18 is then applied 80 to output vacuum head 46. Output vacuum head 46 is then conveyed 82 into output region 52 carrying media 18. Output vacuum head 46 is conveyed 52 into output region 16 by rocking beam 30 on rocking arms 32, 34.

Upon arrival of media 18 into output region 52, the vacuum applied to output vacuum head 46 is removed 84 allowing media 18 to detach from output vacuum head 46. Media 18 remains in output region 52 as output vacuum head 46 is returned to imaging region 50 for removing additional media 18 from imaging region 50.

Figure 9:
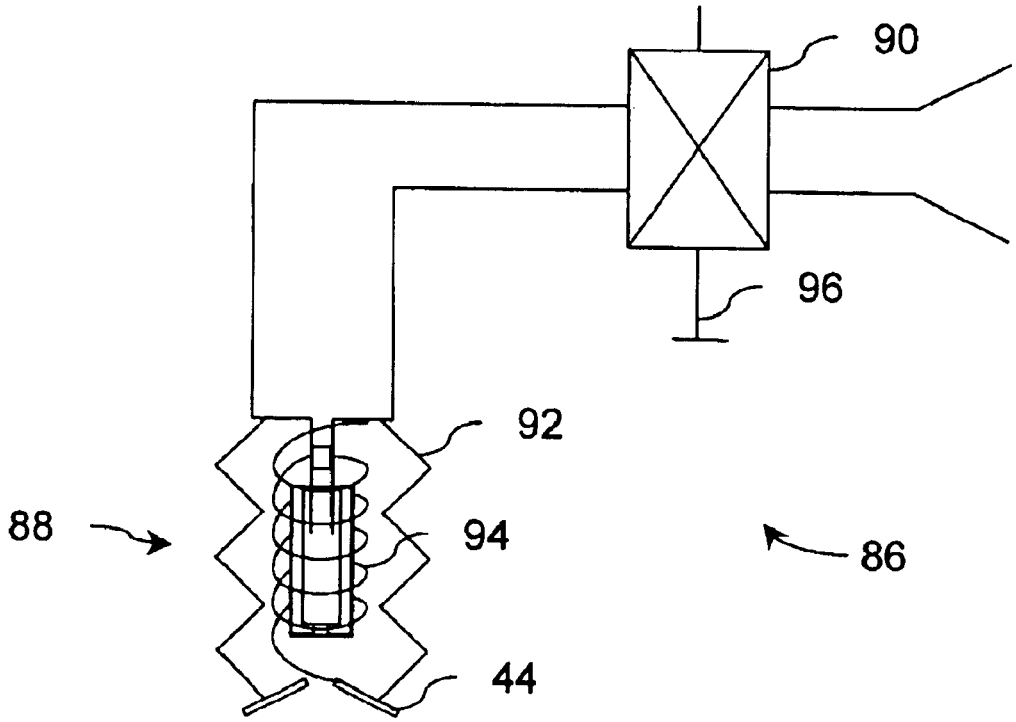
FIG. 9 is a schematic diagram of a bellows vacuum system for providing vacuum for the vacuum heads illustrated in FIGS. 1, 2, and 4–8.

FIG. 9 illustrates one embodiment of a vacuum system 86 for supplying vacuum to the vacuum heads 8, 44, 46 of the present invention. For ease of reference, vacuum system 86 will be described and illustrated only for input vacuum head 44. Vacuum systems 86 for other vacuum heads 8, 46 are similar.

Vacuum system 86 includes a bellows 88 in fluid communication with input vacuum head 44 and exhaust valve 90. Bellows 88 includes an elastomeric boot 92 and a compression spring 94. Exhaust valve 90 includes a toggle activator switch 96.

Bellows 88 is mechanically compressed when input vacuum head 44 is positioned onto media 18 in input region 48. Air is forced out of open exhaust valve 90 by the compression. The same action that compresses bellows 88 also engages toggle activator switch 96 when bellows 88 is fully compressed. Engaging toggle activator switch 96 closes exhaust valve 90. As input vacuum head 44 is removed from input region 48, compression spring 94 acts to expand elastomeric boot 92. The expansion of elastomeric boot 92 generates the vacuum necessary to hold media 18 against input vacuum head 44 while input vacuum head 44 travels to imaging region 50.

Bellows 88 is again mechanically compressed when input vacuum head 44 is positioned forced onto imaging region 50 by beam 30. The same action that forces vacuum head 44 onto imaging region 50 also engages toggle activator switch 96. Engaging toggle activator switch 96 opens exhaust valve 90 allowing an inrush of air to fill the vacuum in input vacuum head 44 and releasing media 18. Input vacuum head 44 then returns to input region 48 leaving media 18 in imaging region 50.

In an alternate embodiment, vacuum system 86 includes at least one vacuum motor (not shown) in fluid communication with the vacuum heads 8, 44, 46 for supplying vacuum to the vacuum heads 8, 44, 46. In this embodiment, a control system (not shown) is required for controlling the vacuum applied to vacuum heads 8, 44, 46. In one embodiment of the control system, the control system controls the vacuum applied to vacuum heads 8, 44, 46 by determining the position of vacuum heads 8, 44 46 and activating and deactivating the vacuum at appropriate locations. The position of vacuum heads 8, 44, 46 may be discovered in a variety of ways all of which are known in the art. For example, sensors (not shown) may be placed so that the sensors are contacted as beam 30 moves into specific locations.

In an alternative embodiment of the control system, sensors are positioned to determine whether media 18 has been picked up by vacuum heads 8, 44, 46. The sensors may either be vacuum sensors or proximity sensors. Vacuum sensors are placed in the fluid stream between the vacuum motor and vacuum head 8, 44, 46. When the sensors perceive a vacuum, media 18 is being held against vacuum head 8, 44, 46. When no vacuum is perceived by the vacuum sensors, media 18 is not being held by vacuum head 8, 44, 46.

Proximity sensor are placed either to sense the proximity of media 18 or the proximity of input region 48, imaging region 50, and output region 52. When the proximity is sensed, the control system assumes media 18 is being held against vacuum head 8, 44, 46. When no proximity is perceived by the proximity sensors, the control system assumes media 18 is not being held by vacuum head 8, 44, 46.

A means (not shown) for releasing the vacuum is also required when using a vacuum motor. The means for releasing the vacuum may be a valve activate by a sensor, or a switch for the shutting off the vacuum motor also activated by a sensor.

Other embodiments of vacuum system 86 are possible and within the scope of the present invention.

Figure 10:
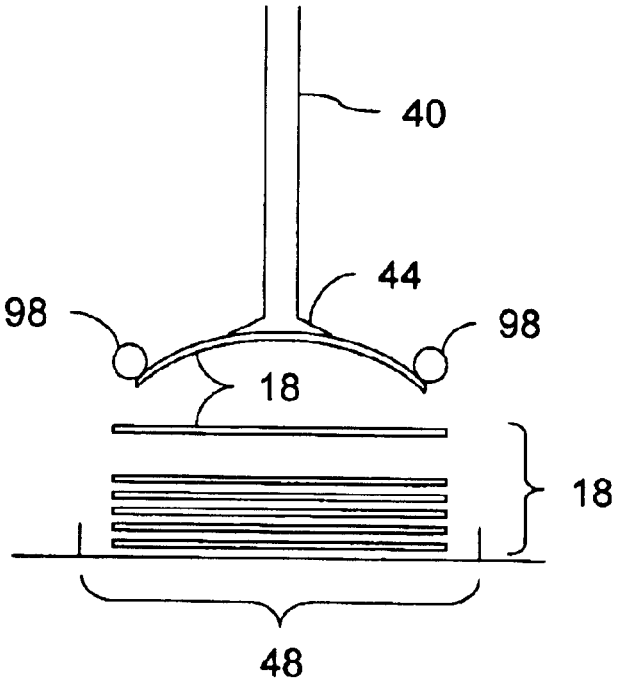
FIGS. 10 and 11 are diagrams illustrating an obstruction for use with the system illustrated in FIGS. 4 through 6.
Figure 11:
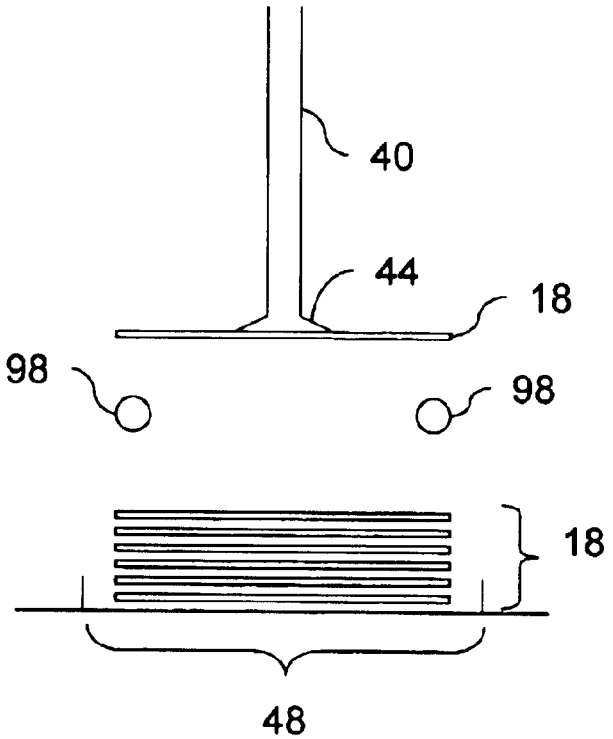

When retrieving a photograph from a stack of photograph, the photographs tend to cling together. Photographs are one type of media 18 contemplated by the present invention. FIGS. 10 and 11 illustrate, in cross-section, an obstruction 98 for ensuring only one media 18 is picked up from input region 12, 48. As media 18 is removed from input region 12, 48, media 18 encounters obstruction 98 causing media 18 to flex. Flexing media 18 ensures only one media is picked up from input region 12, 48.

Other embodiments of obstruction 98 are possible and within the scope of the present invention. Although obstruction 98 is desirable, it is not required for the proper functioning of the present invention.

Figure 12:
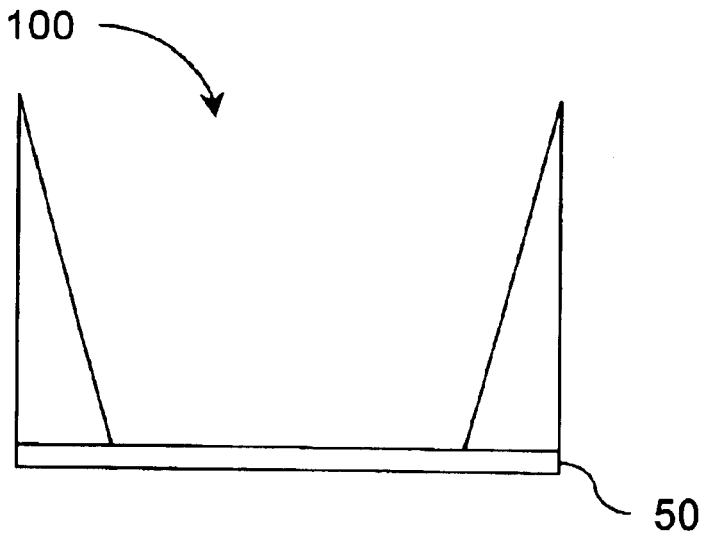
FIG. 12 illustrates an aligning trough for use with the present invention.

FIG. 12 illustrates, an aligning trough 100 for aligning media in imaging region 16, 50. Aligning trough 100 aligns media 18 as it enters imaging region 16, 50. Other embodiments of aligning trough 100 are possible and within the scope of the present invention. Although aligning trough 100 is desirable, it is not required for the proper functioning of the present invention.

Photographs tend to curl slightly. When the media 18 to be imaged is a photograph or other media 18 which tends to curl, it is desirable to have some means for flattening media 18. One means for flatting media 18 for imaging is to apply a vacuum to substantially the entire surface of one side of media 18. This may be easily accomplished when vacuum head 8, 44, 46 is a flat surface roughly the same size as media 18. When vacuum head 8, 44, 46 is not a flat surface roughly the same size as media 18, another means for flattening must be used.

Figure 13:
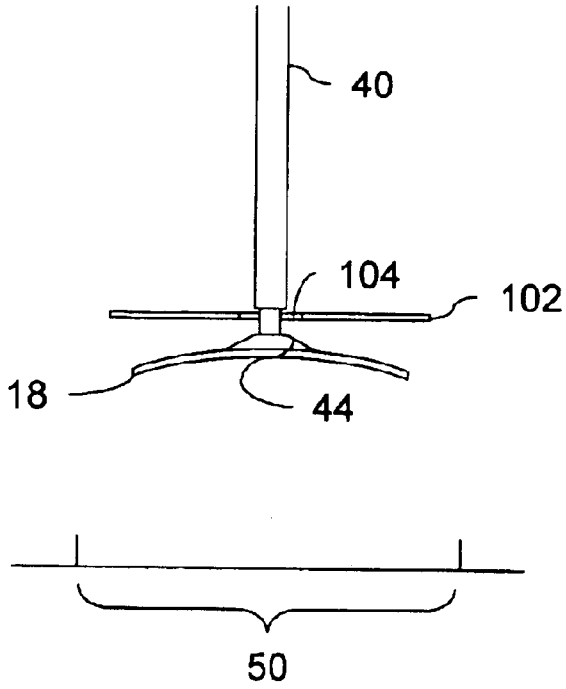
FIGS. 13 and 14 illustrate a media cover for use with the present invention.
Figure 14:
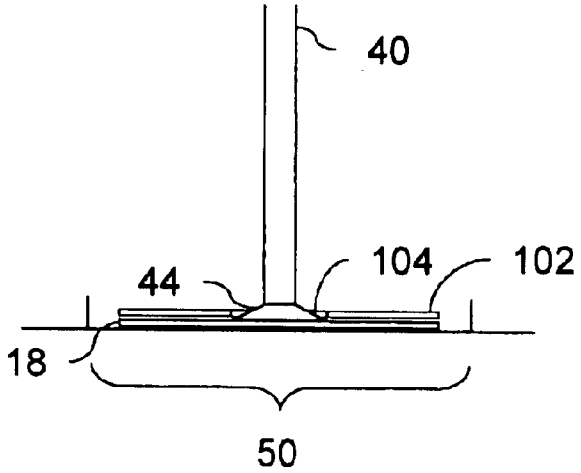

Illustrated in FIGS. 13 and 14 is a media cover 102 for flattening media 18 for imaging. For ease of reference, media cover 102 will be described and illustrated only for input vacuum head 44. Media covers 102 for other vacuum heads 8, 46 are similar.

Media cover 102 includes a flat surface roughly coextensive in size with a standard photograph. A hole 104 should be defined within the approximate center of media cover 102 for allowing support arm 40 and vacuum head 44 to pass through. Media cover 102 is attached to support arm 40 and Vacuum head 44 is spring loaded against support arm 40. The spring loaded forces vacuum head through hole 104 during times when no pressure is applied to vacuum head 44, such as when vacuum head 44 is traveling between input region 48 and imaging region 50. When vacuum head 44 encounters pressure, such as when media 18 is pressed against a surface of imaging region 50, vacuum head 44 is forced through hole 104 and media cover 102 covers media 18, pressing media 18 against the surface of imaging region 50.

It should be understood that the foregoing description is only illustrative of the invention. Various alternatives and modifications can be devised by those skilled in the art without departing from the invention. Accordingly, the present invention is intended to embrace all such alternatives, modifications, and variances that fall within the scope of the appended claims.

What is claimed is:

1. A method for transporting media to an imaging region, the method comprising:

(a) positioning an input vacuum head onto the media;

(b) applying a vacuum to the input vacuum head;

(c) conveying the input vacuum head to the imaging region;

(d) removing the vacuum from the input vacuum head;

(e) positioning an output vacuum head onto the media;

(f) applying a vacuum to the output vacuum head;

(g) conveying the output vacuum head to an output region; and, (h) removing the vacuum from the output vacuum head.

2. A feeder system for transporting media from an input region to an imaging region and then to an output region, the system comprising:

(a) a shaft having a longitudinal axis;

(b) a beam mounted on the shaft;

(c) a vacuum head rotatable about the longitudinal axis of the shaft and movable parallel to the longitudinal axis of the shaft;

(d) a support arm interconnecting the vacuum head and the beam;

(e) a vacuum system in fluid communication with the vacuum head for selectively providing vacuum to the vacuum head; and, (f) at least one driver for rotating the vacuum head about the longitudinal axis of the shaft and moving the vacuum head parallel to the longitudinal axis of the shaft, wherein the at least one driver is linked to the support arm.

3. The system of claim 2 wherein the at least one driver is selectively linked to the shaft or the beam for rotating the shaft about the longitudinal axis of the shaft.

4. The system of claim 2 wherein the at least one driver is linked to the shaft for moving the shaft parallel to the longitudinal axis of the shaft.

5. The system of claim 2 wherein the at least one driver is linked to the beam for moving the beam parallel to the longitudinal axis of the shaft.

6. The system of claim 2 wherein the at least one driver is linked to the support arm for moving the support arm parallel to the longitudinal axis of the shaft.

7. The system of claim 2 wherein the at least one driver is linked to the vacuum head for moving the vacuum head parallel to the longitudinal axis of the shaft.

8. The system of claim 2 wherein the vacuum system includes:

(a) a bellows positioned between the support arm and the vacuum head and in fluid communication with the vacuum head; and, (b) an exhaust valve having a toggle activator switch, the exhaust valve in fluid communication with the bellows, the toggle activator switch for the exhaust valve positioned to be activated when the vacuum head reaches the input region and the output region, wherein the exhaust valve is closed as the vacuum head arrives in the input region and opened as the vacuum arrives in the output region.

9. The system of claim 2 wherein the vacuum system includes:

(a) a vacuum motor in fluid communication with the vacuum head; and, (b) a vacuum control system for sensing the location of the vacuum head and controlling the vacuum motor so that the vacuum head is able to carry the media from the input region to the imaging region and the output region.

10. A feeder system for transporting media from an input region to an imaging region then to an output region, the system comprising:

(a) a beam;

(b) input and output vacuum heads;

(c) input and output support arms, the input and output support arms interconnecting the input and output vacuum heads, respectively, to the beam;

(d) first and second rocker arms, each rocker arm having proximal and distal ends, the proximal end of each rocker arm pivotally fixed in location relative to the imaging region, the distal end of each rocker arm pivotally attached to the beam, wherein the beam and the first and second rocker arms are linearly arranged so that the beam is moveable in a two-dimensional arcing motion, pivoting on the first and second rocker arms; and (e) at least one vacuum system for selectively providing vacuum to the input and output vacuum heads.

11. The system of claim 10 further comprising:

(a) a rotating arm having proximate and distal ends;

(b) a roller rotatably affixed to the distal end of the rotating arm;

(c) a motor having a rotating shaft affixed to the proximate end of the rotating arm; and, (d) a roller retainer affixed to the beam and having a slot formed therein for capturing the roller.

12. The system of claim 10 further comprising:

(a) a rotating arm having proximate and distal ends;

(b) a coupler affixed to the distal end of the rotating arm and interconnecting the rotating arm and the beam; and, (c) a motor having a rotating shaft affixed to the proximate end of the rotating arm.

13. The system of claim 10 wherein the vacuum system includes:

(a) an input bellows and an output bellows, the input bellows positioned between the input support arm and the input vacuum head, the input bellows in fluid communication with the input vacuum head, and the output bellows positioned between the output support arm and the output vacuum head, the output bellows in fluid communication with the output vacuum head; and, (b) input and output exhaust valves each having toggle activator switches, the input exhaust valve in fluid communication with the input bellows and the output exhaust valve in fluid communication with the output bellows, the toggle activator switch for the input exhaust valve positioned to be activated when the input vacuum head reaches the input region and the imaging region, wherein the input exhaust valve is closed as the input vacuum head arrives in the input region and opened as the input vacuum arrives in the imaging region, the toggle activator switch for the output exhaust valve positioned to be activated when the output vacuum head reaches the output region and the imaging region, wherein the output exhaust valve is closed as the output vacuum head arrives in the imaging region and opened as the output vacuum arrives in the output region.

14. The system of claim 10 wherein the vacuum system includes:

(a) a vacuum motor in fluid communication with the input and output vacuum heads; and, (b) a vacuum control system for sensing the location of the input and output vacuum heads and providing vacuum to the input vacuum head so that the input vacuum head is able to carry the media from the input region to the imaging region and providing vacuum to the output vacuum head so that the output vacuum head is able to carry the media from the imaging region to the output region.

15. The system of claim 10 further including an obstruction positioned within the input region wherein media removed from the input region contacts the obstruction causing the media to flex.

16. The system of claim 10 wherein each support arm includes a spring for pressing the each attached vacuum head away from the beam.

17. The system of claim 16 further including a media cover defining a plane, affixed to the input support arm and positioned proximate the input vacuum head and wherein compression of the spring forces the input vacuum head into the plane of the media cover.

18. The system of claim 10 further including an aligning trough positioned within the imaging region wherein media entering the imaging region passes through the aligning trough.

* * * * *